US006658872B1

(12) United States Patent
James

(10) Patent No.: US 6,658,872 B1
(45) Date of Patent: Dec. 9, 2003

(54) AIR CONDITIONER MIST APPLICATOR

(76) Inventor: Dennis James, 121 W. Royale, Richmond, MO (US) 64085

( * ) Notice: Subject to any disclaimer, the term of this patent is extended or adjusted under 35 U.S.C. 154(b) by 0 days.

(21) Appl. No.: 10/147,542

(22) Filed: May 16, 2002

(51) Int. Cl.[7] ..... F28D 5/00; F28D 3/00
(52) U.S. Cl. ..... 62/171; 62/305
(58) Field of Search ..... 62/171, 305, 304, 62/183, 506

(56) References Cited

U.S. PATENT DOCUMENTS 4,193,269 A * 3/1980 Barry ..... 62/171
4,685,308 A 8/1987 Welker et al. ..... 62/171

* cited by examiner

*Primary Examiner*—Chen Wen Jiang
(74) *Attorney, Agent, or Firm*—Mark Manley

(57) ABSTRACT

A must system for use in conjunction with a normally air cooled air conditioner condenser. The mist system provides cooling water to the coils and fins of the condenser to improve efficiency. Misting is normally off but comes on in response to pressure in the high pressure supply line from the condenser rising above a pre-set head pressure level.

8 Claims, 2 Drawing Sheets

AIR CONDITIONER MIST APPLICATOR

BACKGROUND OF THE INVENTION

In air conditioner technology it is desirable to run the air conditioner unit as efficiently as possible both to save on energy and to save wear and tear on the air conditioner. One way to improve efficiency is to spray a fine mist of water on the evaporative condenser. The condenser of the air conditioner is often located outside of the building or space being conditioned. The idea is to improve heat transfer from the condenser by wetting the surface of the metal pipes and fins that make up the condenser's heat transfer system.

A number of attempts have been made to perfect this type of wetting system. U.S. Pat. No. 4,685,308 to Welker et al discloses one such system. Water for the misters is usually supplied from a tap. Typically something then trips a valve to activate the mist when the A/C unit is running. In the case of Welker the system detects a high temperature to initiate mist flow. The idea is to supply water in the form of mist only when it is needed and to avoid excessive flow when not needed. Misting the condenser when it is not running hot can result in the condenser freezing up, which reduces efficiency to near zero and can ruin the unit. Excess water also results in waste and undesirable amounts of water on the ground around the unit.

Prior art devices have attempted to measure some indicator that the condenser is running such as vibration, heat or airflow to indicate a need for mist. The problem is that these are not true measures of the need for mist. The true measure of the need for mist cooling is the head pressure of the refrigerant leaving the condenser to return to the evaporator. This head pressure is a true indicator of the need for mist. As the head pressure increases past a designed pressure the unit will lose efficiency. Misting the condenser will reduce the head pressure. Another problem with prior art units is that they introduce a device with components that the air conditioner service technician is not familiar with.

SUMMARY OF THE INVENTION

The present invention solves the limitations of the prior art devices. The current invention provides an air conditioner condenser mist device activated only as the head pressure in the coolant leaving the condenser exceeds a certain preset level. The current device provides a mister that uses valves and systems with which most air conditioner service people are already familiar. The current invention provides a reliable system with a minimum of moving parts.

DETAILED DESCRIPTION OF THE DEVICE

Figure 1:
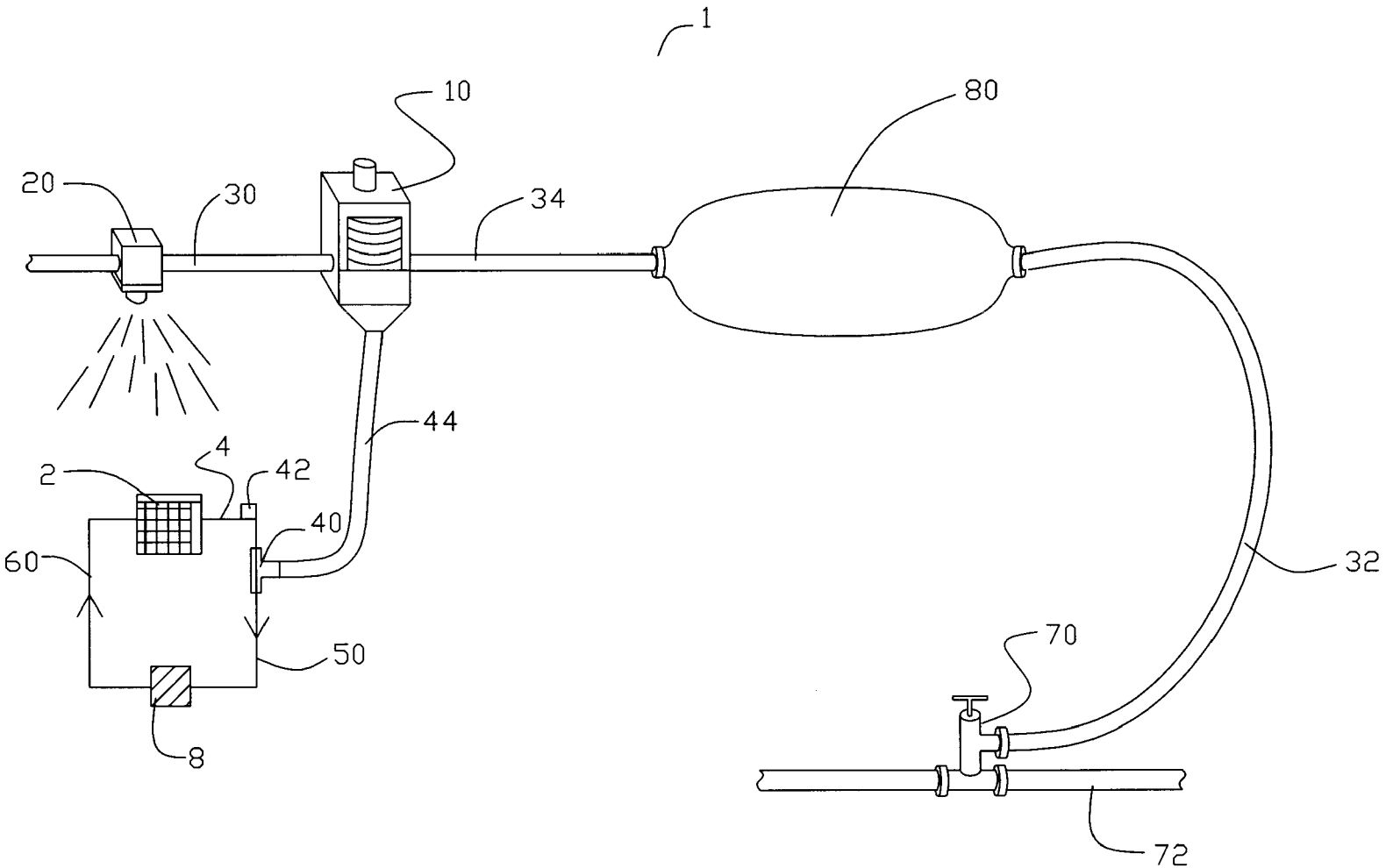
FIG. 1 Shows a schematic system for applying mist to an air conditioner condenser unit FIG. 2 Shows a view of the system installed on a condenser unit
Figure 2:
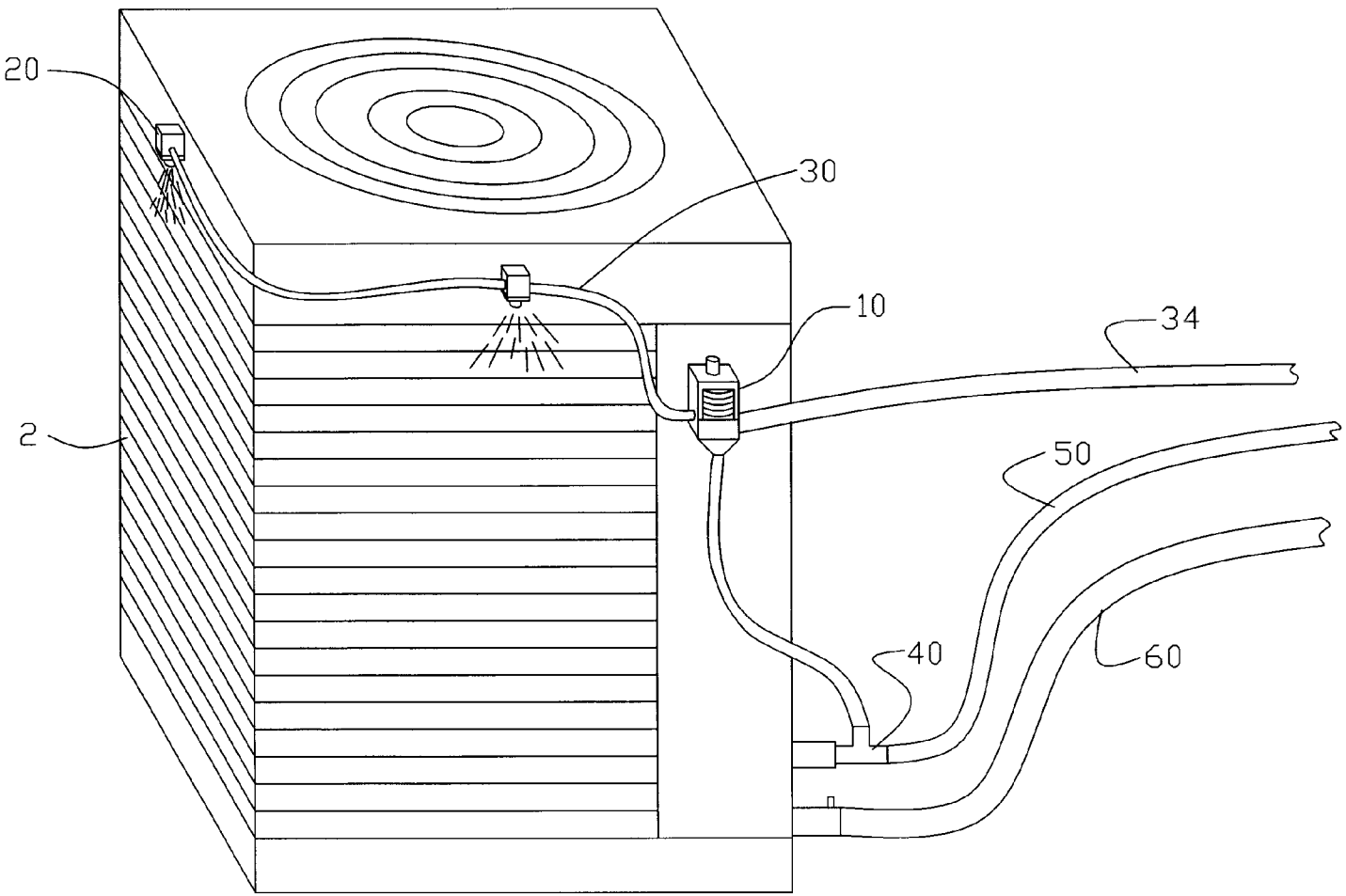

FIG. 1 shows a basic schematic view of the mist system (1). FIG. 2 gives an external view of the appearance of the device at the condenser (2). Referring to FIGS. 1 and 2, a pressure activated water control valve (10) supplies water to a mist nozzle (20) through water line (30). The mist nozzle supplies water at a rate of about one gallon per hour at 100 PSI water pressure. The water control valve (10) receives a signal indicating high head pressure in the high pressure side (4) of the refrigerant system from a "tee" adapter (40) tied in to the existing service valve connection (42) present on most air conditioners. Thus line (44) is constantly pressurized at a level equal to the head pressure in the refrigerant high pressure side (4) from the condenser (2). Line (60) is the low pressure return line to the condenser (2) from the evaporator (8) inside the conditioned space.

Water is supplied from a water line tap (70) attached to a water line (72). A water line (32) from the tap (70) supplies water through a filter (80) to the line (34) which provides water to the water valve (10).

In operation the water control valve (10) is the main part of the mist system (1). It is connected to the high pressure line (4) from the condenser (2) to the evaporator (8). The head pressure controls the water valve (10). When the high pressure goes over a set point the valve (10) will open and let water from the tap (70) through to the mist nozzles (20). The "set point" must be set by a technician and will vary depending upon the type of air conditioner, environmental conditions and desired operation. The system must be balanced to maximize efficiency but to minimize any risk of unit freeze up and to minimize the amount of water on the ground.

The mist nozzles (20) are mounted around the top of the condenser unit as shown in FIG. 2. The condenser unit fan (not shown) will pull the mist through the condenser coils where it will wet the surface of the condenser coils and fins. Once wet, the water evaporating off the coils will speed the rate of heat transfer to the environment, improving the cycle efficiency and reducing wear on the air conditioner.

The water filter (80) is of the type used to take minerals such as calcium out of. water. A 3 micron filter unit is widely available commercially. Hard water would cause the nozzles (20) to plug up over time, so the unit will work with less maintenance with a filter.

Most of the devices used in the construction of the mist system are either simple components or items with which the air conditioning technician will already be familiar. The water control valve is one already in use in water cooled ice makers and air conditioners. The tap (70) and filter (80) are units already commonly in use with the water supply to household icemakers.

What is claimed is:

1. A mist system for use in combination with an air conditioner compressor normally cooled by a flow of air, said mist system comprising:

a plurality of mist nozzles mounted on said air conditioner compressor, a valve in fluid communication with said nozzles, a high pressure line supplying refrigerant from said compressor to an evaporator, said valve receiving a portion of said refrigerant through a line, a tap for supplying water to said valve and said valve opening in response to receiving said refrigerant at a pre-set pressure level such that water can flow from said tap through said valve and to said nozzles when pressure in the high pressure supply line exceeds the pre-set pressure level.

2. The mist system of claim 1 wherein said water from said tap flows through a filter prior to entering said valve.

3. The mist system of claim 1 wherein the valve is normally closed.

4. A mist system for use in combination with an air conditioner compressor normally cooled by a flow of air, said mist system comprising:

at least one mist nozzles mounted on said air conditioner compressor, a valve in fluid communication with said at least one nozzle, a high pressure line supplying refrigerant from said compressor to an evaporator, said valve receiving a portion of said refrigerant through a line, a tap for supplying water to said valve and said valve opening in response to receiving said refrigerant at a pre-set pressure level such that water can flow from said tap through said valve and to said at least one nozzle when pressure in the high pressure refrigerant line exceeds the pre-set pressure level.

5. A mist system for use in combination with an air conditioner compressor normally cooled by a flow of air, said mist system comprising:

a plurality of mist nozzles mounted on said air conditioner compressor, a pressure activated water control valve in fluid communication with said nozzles, a high pressure line supplying refrigerant from said compressor to an evaporator, said pressure activated water control valve receiving pressure from a portion of said refrigerant, a tap for supplying water to said pressure activated water control valve and said pressure activated water control valve opening in response to receiving said refrigerant at a pre-set pressure level such that water can flow from said tap through said pressure activated water control valve and to said nozzles when pressure in the high pressure refrigerant line exceeds the pre-set pressure level.

6. The mist system of claim 5 wherein said pressure activated water control valve receives refrigerant from a tee in said high pressure line.

7. The mist system of claim 6 wherein said water from said tap flows through a filter prior to entering said pressure activated water control valve.

8. The mist system of claim 7 wherein the pressure activated water control valve is normally closed.

* * * * *